US009714801B2

(12) United States Patent
Conle

(10) Patent No.: US 9,714,801 B2
(45) Date of Patent: Jul. 25, 2017

(54) AUTOMATIC HANDGUN

(71) Applicant: Henning Conle, Zurich (CH)

(72) Inventor: Henning Conle, Zurich (CH)

( * ) Notice: Subject to any disclaimer, the term of this patent is extended or adjusted under 35 U.S.C. 154(b) by 0 days.

(21) Appl. No.: 14/751,322

(22) Filed: Jun. 26, 2015

(65) Prior Publication Data

US 2016/0061544 A1 Mar. 3, 2016

(30) Foreign Application Priority Data

Jun. 26, 2014 (AT) ..... A 507/2014

(51) Int. Cl.

| | |
|---|---|
| ***F41A 5/20*** | (2006.01) |
| ***F41A 3/54*** | (2006.01) |
| ***F41A 3/64*** | (2006.01) |
| ***F41A 19/30*** | (2006.01) |

(52) U.S. Cl.

CPC *F41A 5/20* (2013.01); *F41A 3/54* (2013.01); *F41A 3/64* (2013.01); *F41A 19/30* (2013.01)

(58) Field of Classification Search

CPC ..... F41A 3/12; F41A 3/26; F41A 3/44; F41A 3/54–3/56; F41A 3/64–3/66; F41A 3/78; F41A 3/86–3/88; F41A 5/18–5/20; F41A 7/00; F41A 7/08; F41A 11/00–11/02; F41A 19/30

USPC ..... 89/125, 132, 180, 194–197

See application file for complete search history.

(56) References Cited

U.S. PATENT DOCUMENTS

| | | | | | |
|---|---|---|---|---|---|
| 1,377,629 | A | * | 5/1921 | Rosebush | F41A 11/02 42/75.03 |
| 1,516,540 | A | | 11/1924 | Mann | |
| 1,840,054 | A | * | 1/1932 | Reising | F41A 17/38 42/75.02 |
| 1,911,494 | A | * | 5/1933 | Floyd | F41A 17/28 42/1.04 |
| 2,377,703 | A | * | 6/1945 | Loomis | F41A 3/32 42/22 |
| 2,529,359 | A | * | 11/1950 | Stevens | F41A 17/36 89/148 |
| 2,655,839 | A | * | 10/1953 | Ruger | F41A 3/68 42/25 |
| 2,744,448 | A | * | 5/1956 | Allen | F41A 3/54 42/69.03 |
| 2,765,710 | A | * | 10/1956 | Bradley | F41A 3/50 89/182 |
| 3,167,876 | A | * | 2/1965 | Milroy, Jr. | F41A 9/17 42/18 |
| 3,306,168 | A | * | 2/1967 | Blumrick | F41A 3/38 42/75.02 |

(Continued)

FOREIGN PATENT DOCUMENTS

| | | |
|---|---|---|
| DE | 1040420 | 10/1958 |
| DE | 3142350 A1 | 5/1983 |

(Continued)

*Primary Examiner* — Stephen M Johnson
*Assistant Examiner* — Benjamin Gomberg
(74) *Attorney, Agent, or Firm* — Laurence A. Greenberg; Werner H. Stemer; Ralph E. Locher

(57) ABSTRACT

A fully automatic handgun has a barrel and a blowback, open bolt firing breech mechanism, which is mounted in a displaceable manner on a guide. The breech mechanism has a slide with a substantially U-shaped bracket, on which a breechblock is arranged. The slide is displaceably mounted on the guide and on the barrel.

18 Claims, 9 Drawing Sheets

(56) References Cited

U.S. PATENT DOCUMENTS

| | | | | | |
|---|---|---|---|---|---|
| 3,696,706 | A * | 10/1972 | Seidel | F41A 3/66 | 42/71.02 |
| 4,048,901 | A * | 9/1977 | Ghisoni | F41A 3/64 | 42/25 |
| 4,061,075 | A * | 12/1977 | Smith | F41A 5/16 | 42/11 |
| 4,127,056 | A * | 11/1978 | Kart | F41A 21/488 | 42/75.02 |
| 4,567,810 | A * | 2/1986 | Preston | F41A 17/38 | 89/142 |
| 4,579,037 | A | 4/1986 | Gillum | | |
| 4,602,450 | A * | 7/1986 | Hoenig | F41A 21/487 | 42/75.02 |
| 5,123,329 | A * | 6/1992 | Irwin | F41A 5/16 | 89/14.3 |
| 5,736,667 | A * | 4/1998 | Munostes | F41A 11/00 | 42/16 |
| 6,079,138 | A * | 6/2000 | Meaker | F41A 3/44 | 42/17 |
| 8,528,243 | B1 * | 9/2013 | Glock | F41A 3/66 | 42/75.02 |
| 2004/0007124 | A1 | 1/2004 | Nakatani | | |
| 2006/0266209 | A1 * | 11/2006 | Grabowski | F41A 3/86 | 89/198 |
| 2014/0026745 | A1 | 1/2014 | Lee | | |

FOREIGN PATENT DOCUMENTS

| | | | |
|---|---|---|---|
| DE | 102004021952 | B3 | 12/2005 |
| EP | 0159441 | A2 | 10/1985 |

* cited by examiner

Fig. 3
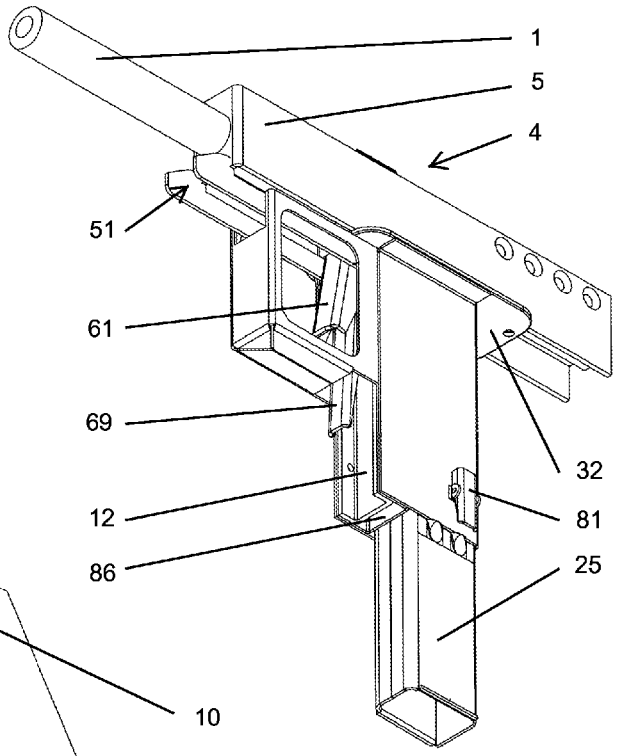
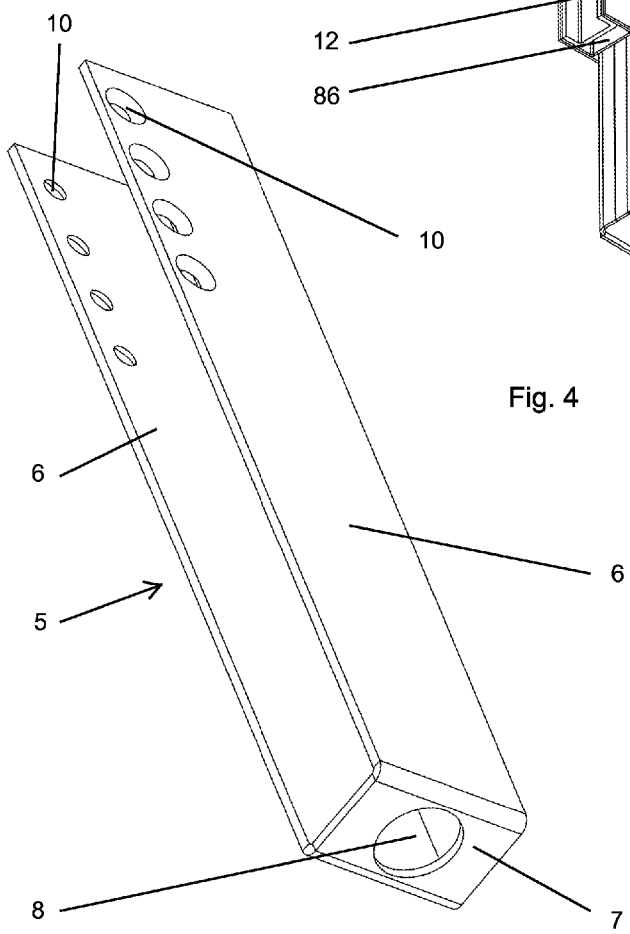
Fig. 4

Fig. 7a
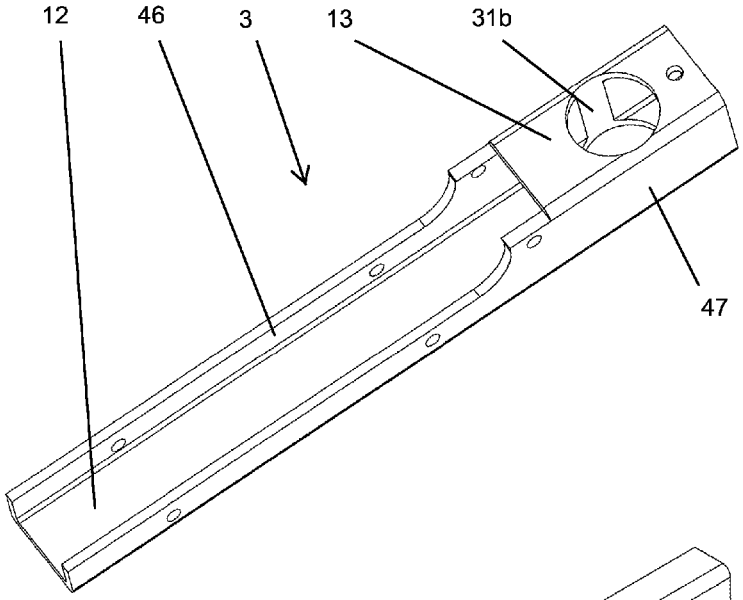
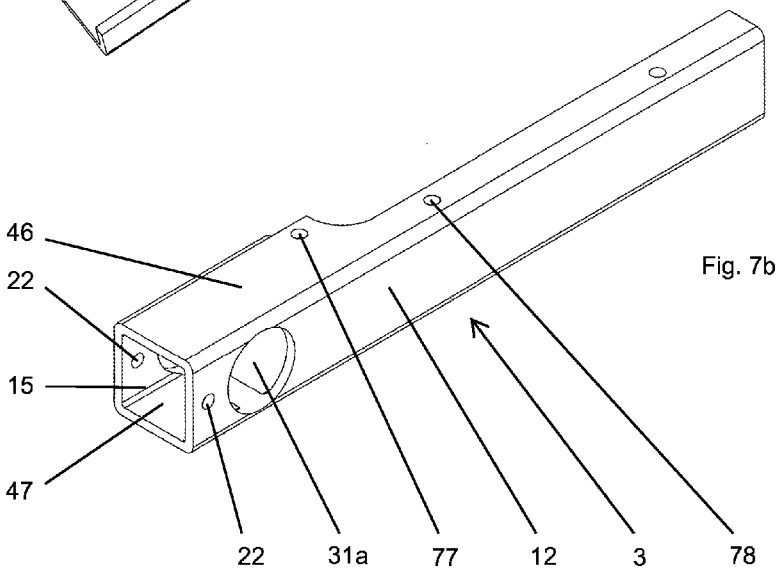
Fig. 7b

Fig. 8
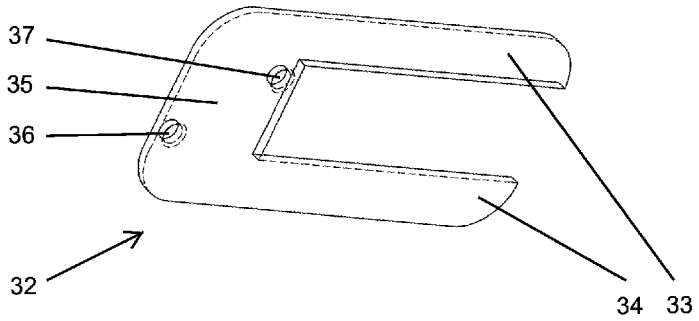
Fig. 9
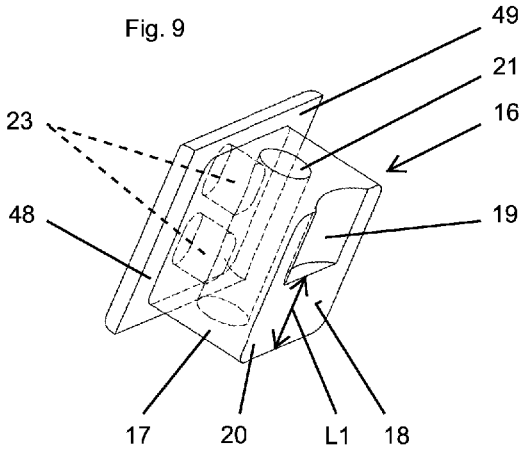
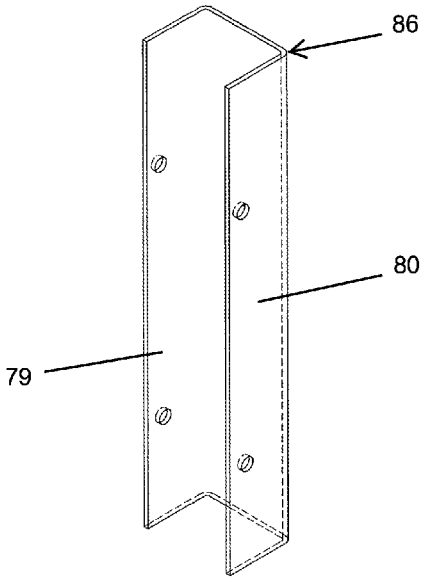
Fig. 10

Fig. 14a
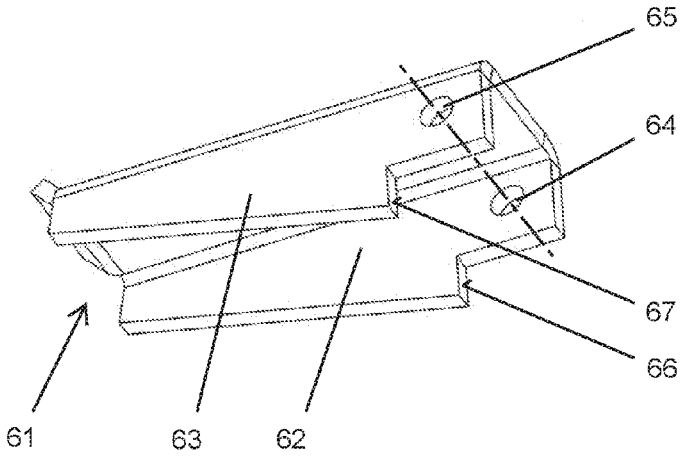
Fig. 14b
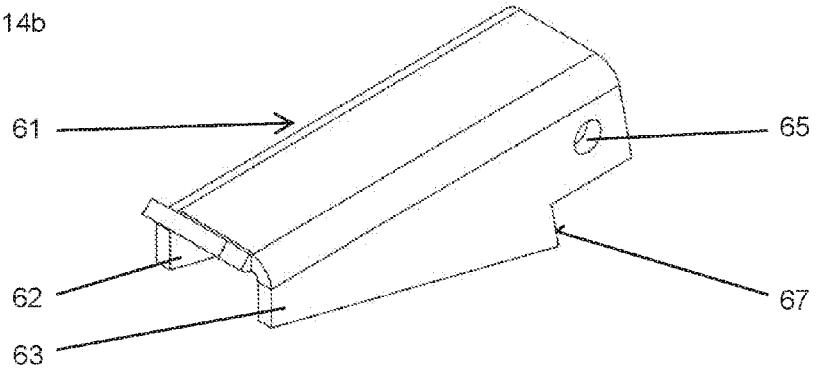
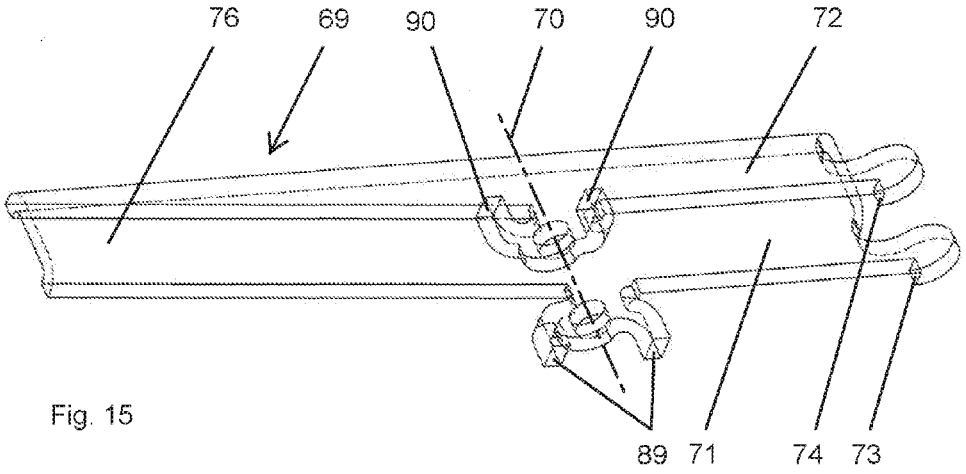
Fig. 15

AUTOMATIC HANDGUN

CROSS-REFERENCE TO RELATED APPLICATION

This application claims the priority, under 35 U.S.C. §119, of Austrian patent application A 507/2014, filed Jun. 26, 2014; the prior application is herewith incorporated by reference in its entirety.

BACKGROUND OF THE INVENTION

Field of the Invention

The invention relates to a fully automatic handgun having a barrel and an open bolt firing breech mechanism, which is mounted in a displaceable manner on a guide.

The weapon according to the invention is constructed in accordance with the known principle of an open bolt breech firing mechanism (also referred to as a blowback breech mechanism). In the case of a ready-to-fire weapon, there is no cartridge in the chamber and the breech mechanism is secured in a rear position. When the trigger is activated, the breech mechanism is freed and moved forward, in the direction of the barrel, by a spring. In the process, it carries along a cartridge out of the magazine, pushes it into the chamber and ignites it as a result of the impact of the firing pin on the primer of the cartridge. As a result of the mass inertia, the breech mechanism secures the cartridge case in the chamber substantially until the bullet has left the barrel. The cartridge case and the breech mechanism are then moved rearwards by the chamber pressure until the breech mechanism, when pressure on the trigger has been released, is arrested again. The cartridge case is ejected during the return movement. While the trigger remains pulled, this operation is repeated as long as there is ammunition present, rendering the weapon an automatic gun.

SUMMARY OF THE INVENTION

It is accordingly an object of the invention to provide an automatic handgun which overcomes the above-mentioned and other disadvantages of the heretofore-known devices and methods of this general type and which can be produced in as straightforward and advantageous a manner as possible.

With these and other objects in view there is provided, in accordance with the invention, an automatic handgun, comprising:

a barrel;

a blowback breech mechanism having a slide with a substantially U-shaped bracket and a breechblock disposed on the U-shaped bracket; and the slide being mounted for displacement on a guide and on the barrel.

In other words, the objects of the invention are achieved, in that the breech mechanism has a slide with a substantially U-shaped bracket, on which a breechblock is arranged, and in that the slide is mounted in a displaceable manner on the guide and on the barrel.

In accordance with an added feature of the invention, a compression spring is disposed to enclose the barrel and it is clamped in between the bracket and the guide.

In a preferred embodiment of the invention, the guide is arranged on a trigger assembly.

In accordance with an additional feature of the invention, the bracket is formed of an angled metal sheet. The U-shaped bracket is formed with legs having free ends and the breechblock is accommodated between the legs at the free ends of the legs. The breechblock is affixed to the legs at the free ends, in particular screwed or riveted.

In accordance with again an additional feature of the invention, the barrel projects through an opening formed in a base of the U-shaped bracket.

In accordance with another feature of the invention, the guide is formed with two mutually opposite U-shaped depressions, and respective legs of the U-shaped bracket are guided in the depressions. Advantageously, the guide is arranged on a barrel holder, and the barrel is releasably fastened on the barrel holder. The barrel holder may be substantially cuboidal in a guide region and the U-shaped depressions are delimited by protrusions disposed thereon, i.e., either formed thereon or attached thereto. In accordance with a further feature of the invention, a pair of protrusions are disposed on a locking part, the locking part is fastened at an end of the barrel holder, and the locking part engages in a depression on the barrel.

In accordance with a further feature of the invention, there is provided a magazine well and a carrier plate disposed in the magazine well. Preferably, a second guide for the slide, especially for the breech block, is fastened at the carrier plate. The carrier plate may be formed with a second pair of protrusions. Also, a barrel holder is fastened on the magazine well. The barrel holder comprises a rectangular profile tube with two openings in opposite walls, through which the barrel projects transversely to a longitudinal direction of the profile tube. The locking part is plugged into an end of the profile tube and fastened there.

In accordance with yet a further feature of the invention, at least one latching protrusion is formed on the slide and a pivotably mounted catch is arranged on the magazine well. Preferably, the catch is a bracket that is bent substantially in a U-shape and has two legs, at the ends of which latching hooks are arranged, and wherein a trigger, which is mounted along a same axis as the catch, acts on a base that connects the two legs. A pivotally mounted safety bracket acts on the base, on a side opposite the trigger, and a handle part of the safety bracket runs in extension of the trigger.

In a preferred embodiment of the invention, the catch, the trigger and the safety bracket are mounted on the barrel holder. The trigger assembly may be fastened on the magazine well.

Other features which are considered as characteristic for the invention are set forth in the appended claims.

Although the invention is illustrated and described herein as embodied in an automatic handgun, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, which are not drawn entirely to scale.

BRIEF DESCRIPTION OF THE SEVERAL VIEWS OF THE DRAWING

FIG. 3 shows the handgun in an oblique view as seen from a different perspective;

FIG. 4 shows a U-shaped bracket of the handgun;

FIGS. 7*a* and 7*b* show a barrel holder of the handgun;

FIG. 8 shows a carrier plate of the handgun;

FIG. 9 shows a locking part of the handgun;

FIG. 10 shows a wall element of the magazine well of the handgun;

FIGS. 14*a* and 14*b* show a trigger of the handgun;

FIG. 15 shows a safety bracket of the handgun;

DETAILED DESCRIPTION OF THE INVENTION

Figure 1:
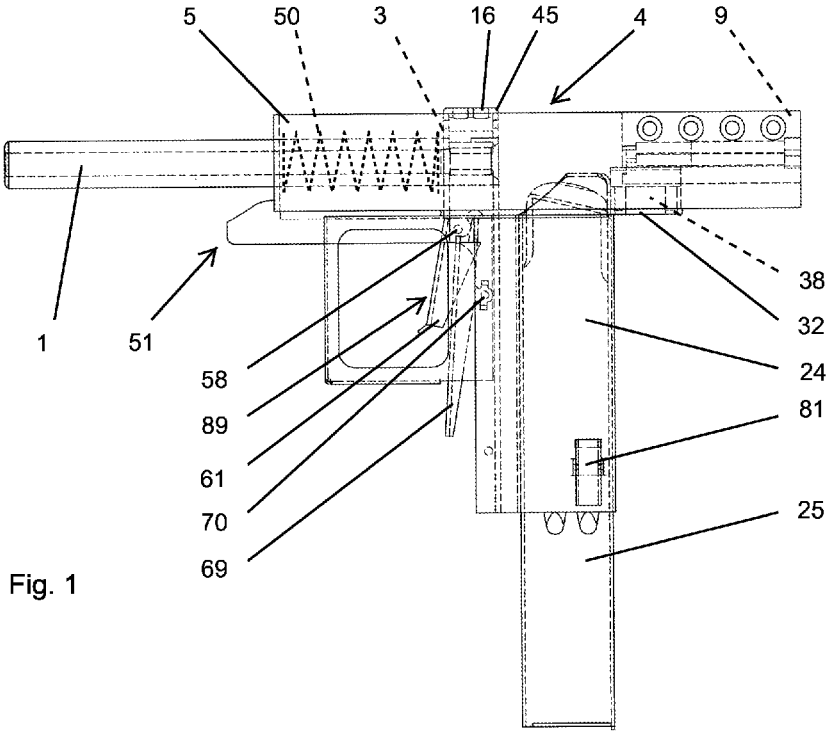
FIG. 1 shows a side view of a preferred embodiment of a handgun according to the invention.

Referring now to the figures of the drawing in detail and first, particularly, to FIG. 1 thereof, there is shown a preferred embodiment of the handgun according to the invention with a barrel 1, of which the chamber end 2 is fastened on a barrel holder 3. A breech mechanism 4, which is configured in the manner of a blowback breech mechanism, substantially comprises a bracket 5 which is bent in a U-shape with two legs 6 and a base 7, which connects the legs. The base 7 has an opening 8, through which the barrel 1 is guided. A breechblock 9 is fastened at the free ends of the legs 6. The breechblock 9 is preferably screwed to the legs 6, but can also be fastened thereon in some other manner, e.g. by riveting or welding. For screw connection, the ends of the legs have countersunk holes 10 and the breechblock 9 has threaded bores 11, into which countersunk screws can be screwed in through the countersunk holes 10. The bracket 5 can easily be produced by virtue of being punched out of the metal sheet and bent.

Figure 5:
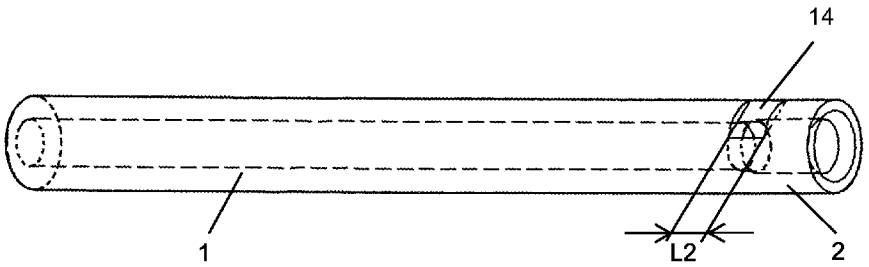
FIG. 5 shows a barrel of the handgun.

In the embodiment illustrated, the barrel holder 3 (FIGS. 7*a* and 7*b*) comprises a quadrilateral tube, of which the opposite walls 12, 13 have bores 31*a*, 31*b*, in which the chamber end 2 of the barrel 1 can be accommodated. A depression 14 is provided at the chamber end 2 of the barrel 1 (FIG. 5) and, when the barrel 1 is in the installed position, said depression is oriented towards the upper end 15 of the barrel holder 3 and is arranged in the interior of the barrel holder 3.

A locking part 16 (FIG. 9) comprises a cuboidal block 17, which is plugged into the end 15 of the barrel holder 3. On its underside 18, the locking part has an aperture 19, of which the curvature corresponds to the external diameter of the chamber end 2 of the barrel 1. The depth of the aperture 19 on the locking part 16 corresponds approximately to the depth of the aperture 14 on the barrel 1, and the remaining length L1 on the underside 18 of the locking part 16 is essentially equal to the length L2 of the aperture on the barrel 1, and therefore the locking part 16 engages, by way of the resulting protrusion 20, in the aperture 14 on the barrel 1 and fixes the latter both axially and in the circumferential direction.

In order to fasten the locking part 16, a bore 21 is formed therein, and bores 22 are likewise provided in the walls 12, 13 of the barrel holder 1, it being possible for a locking pin to be plugged through the bores. The locking pin can be secured for its part, for example, by grub screws in bores 23 on the locking part 16.

Figure 6B:
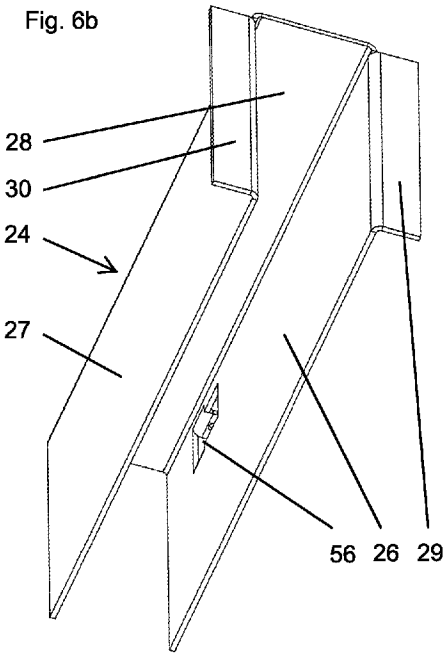
FIGS. 6*a* and 6*b* show a magazine well of the handgun.
Figure 6A:
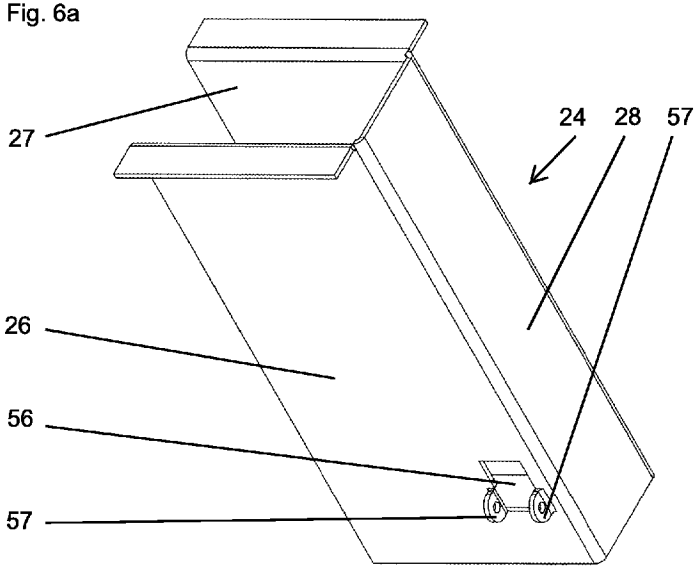
Figure 11A:
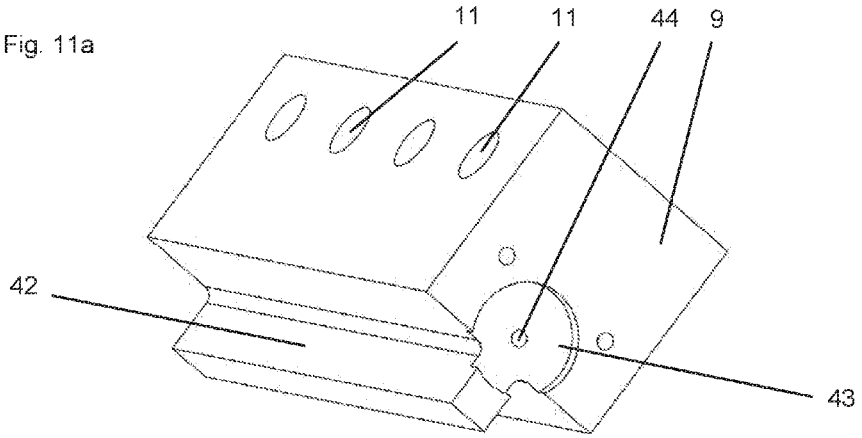
FIGS. 11*a* and 11*b* show a breechblock of the handgun.
Figure 11B:
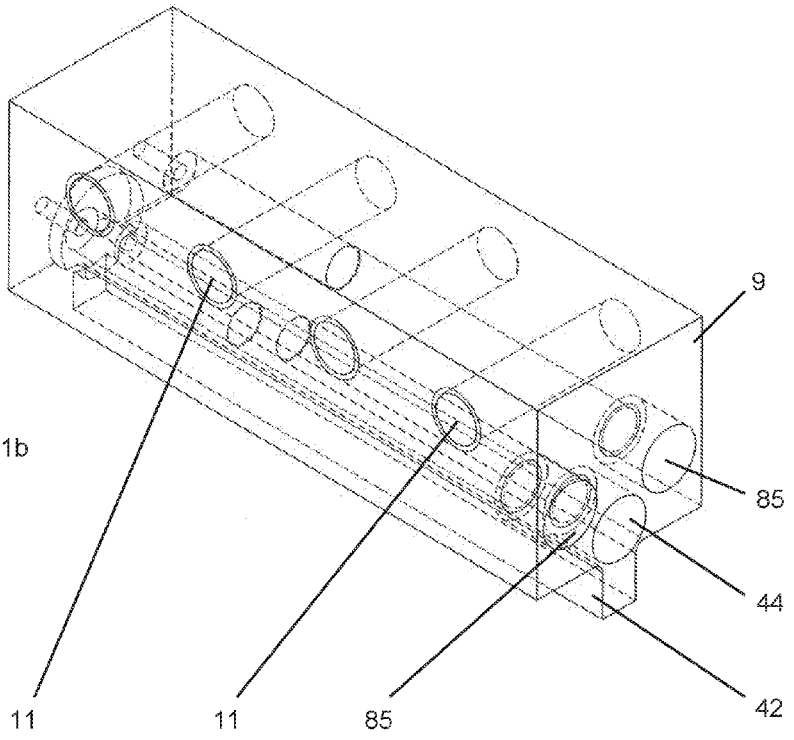

The weapon according to the invention has a magazine well 24 (FIGS. 6*a* and 6*b*), in which a box magazine 25 which is known per se is accommodated, as is known per se, in a releasable manner. The magazine well 24, which, at the same time, can form a handle, but may also be enclosed by a casing, e.g. made of wood or plastics material, in order for carrying, holding and shooting comfort to be enhanced, can likewise easily be produced by virtue of being punched out of the metal sheet and bent, and it is U-shaped with two side walls 26, 27 and a rear wall 28. The fourth wall is formed by a U-shaped wall element 86 (FIG. 10), which is inserted between the side walls 26, 27 and of which the side walls 79, 80 are connected, e.g. spot welded, to the side walls 26, 27.

Two lugs 29, 30, which are bent outward at right angles, are located at the upper ends of the side walls 26, 27 of the magazine well 24. An aperture 56 with two outwardly bent lugs 57 for bearing a locking lever 81 (FIG. 16) is provided in one wall 26.

Figure 12A:
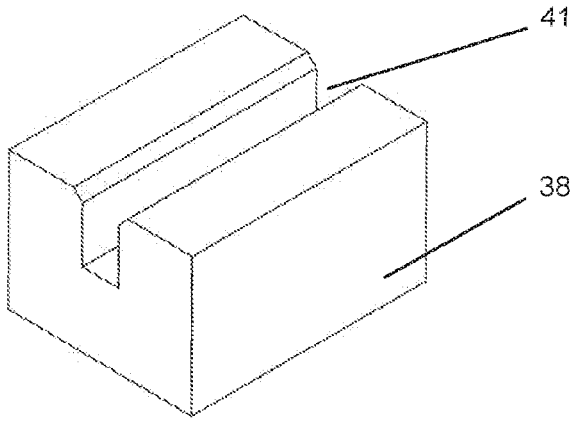
FIGS. 12*a* and 12*b* show a guide of the handgun.
Figure 12B:
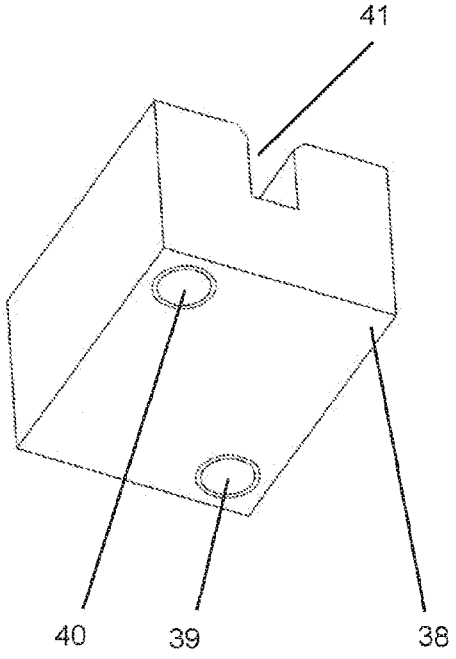

A carrier plate 32 (FIG. 8), which is preferably likewise produced by virtue of being punched out of the metal sheet, is U-shaped with two legs 33, 34, by way of which it is fastened on, e.g. welded to, the lugs 29, 30 of the magazine well 24. The base 35 of the carrier plate 32 has two bores 36, 37, through which a guide 38 for the breechblock 9 can be screwed to the carrier plate 32. In the embodiment illustrated, the guide 38 (FIGS. 12*a* and 12*b*) is a solid, cuboidal block with two threaded bores 39, 40, the positioning of which corresponds to that of the bores 36, 37 on the carrier plate. On the upper side, which is located opposite the carrier plate 38, a cuboidal block has a guide groove 41, in which a crosspiece 42 on the underside of the breechblock 9 can be displaced.

Figure 17A:
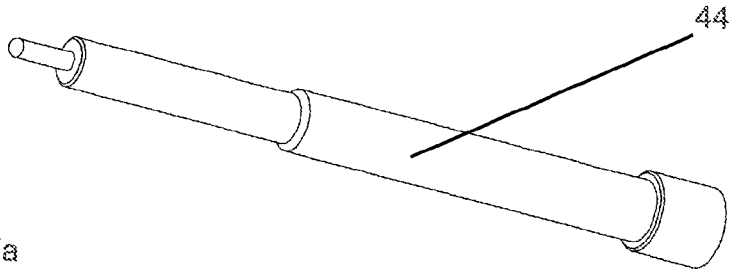
FIGS. 17*a* and 17*b* show a firing pin of the handgun.
Figure 17B:
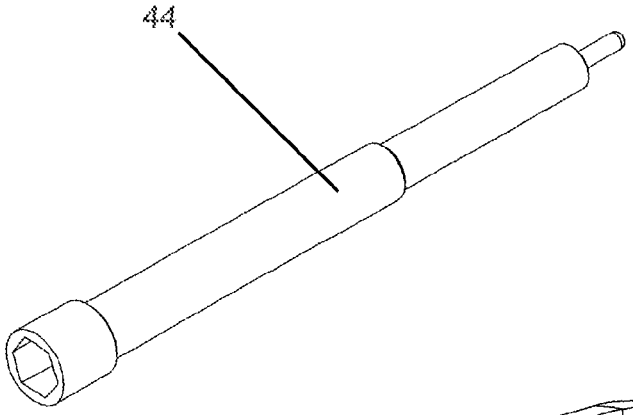

The breechblock 9 also has arranged on it a recessed breech face 43 and a fixed, possibly interchangeable, firing pin 44 (FIGS. 17*a* and 17*b*). The firing pin 44 may be interchangeable, for which purpose, for example, two spare mounts 85 may be provided in the breechblock 9.

The legs 6 of the U-shaped bracket 5 are guided such that they can be displaced in a longitudinal direction on a respective guide 45 on opposite sides of the barrel holder, which is substantially U-shaped. The base of the U shape is formed in each case by one of the mutually opposite walls 46, 47 of the barrel holder 3. The side walls of the U-shaped guides are formed by upper and lower protrusions. The upper protrusions 48, 49 are formed by a projecting periphery on the locking part 16 and the lower protrusions are formed by the legs 33, 34 of the carrier plate 32.

The slide, comprising the U-shaped bracket 5 and the breechblock 9, is thus guided in three ways, that is to say by way of the opening 8 on the bracket 5, by the legs 6 on the barrel holder 3 and by the crosspiece 42 on the guide part 38. The slide is pushed forward by a compression spring 50, which is clamped in between the barrel holder 3 and the base 7 of the bracket 8 and encloses the barrel 1.

Figure 2:
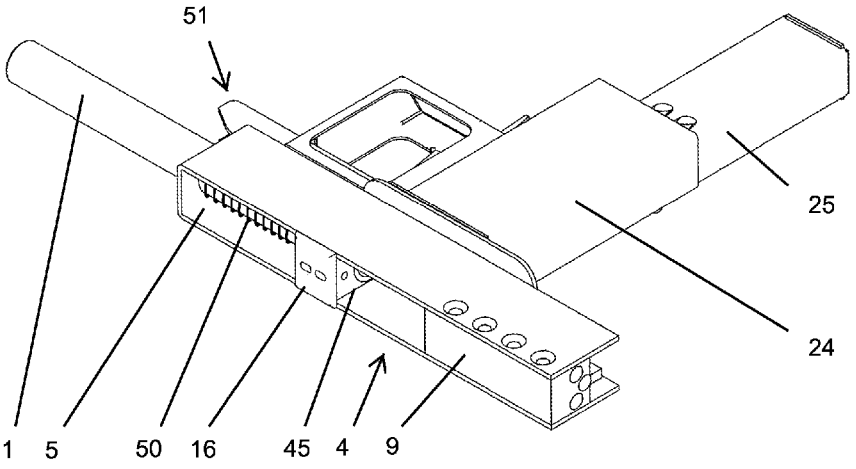
FIG. 2 shows the handgun in an oblique view.
Figure 13:
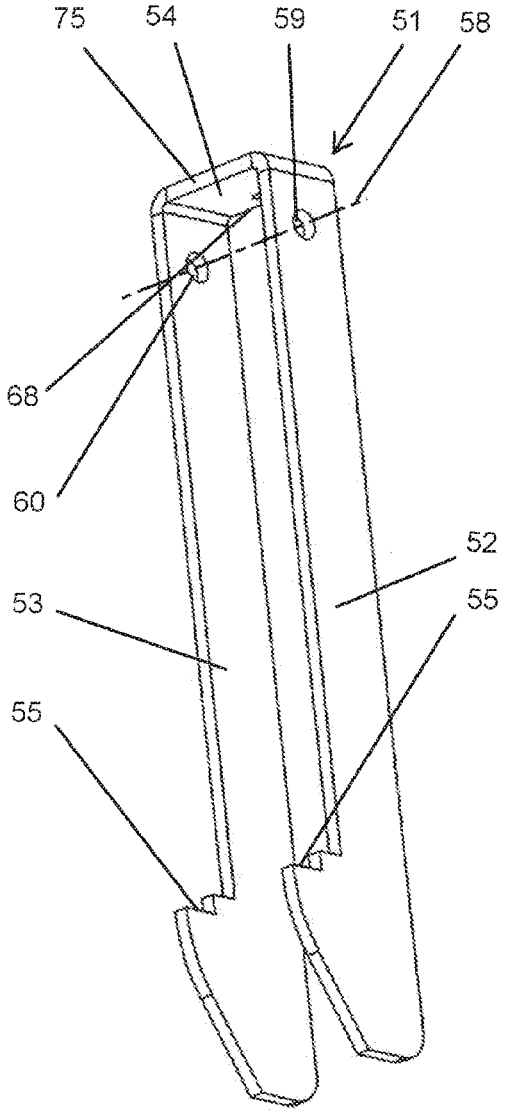
FIG. 13 shows a catch of the handgun.

In its rear position, which is illustrated in FIGS. 1 to 3, the slide is retained by a catch 51, which is illustrated in FIG. 13 and preferably comprises a punched sheet-metal part, which has been bent in a U-shaped manner, and two legs 52, 53 and a base 54. Latching hooks 55 are arranged at the ends of the legs 52, 53 of the catch 51 and act on the base 7 of the U-shaped bracket 5. The free ends of the legs 52, 53, for reasons relating to stability, may be connected to one another. The catch 51 can be pivoted about an axis 58, which are defined by bores 59, 60 in the legs 52, 53.

A trigger 61 (FIGS. 14*a* and 14*b*), which likewise preferably comprises a punched sheet-metal part which has been bent in a U-shaped manner, has, in two legs 62, 63, bores 64, 65, which likewise define a pivot axis which, in the installed state, coincides with the axis 58 of the catch and is formed by a common bolt. The trigger 61 is somewhat narrower than the catch 51 and is accommodated between the legs 52, 53 thereof.

The two legs 62, 63 of the trigger 61 have abutment surfaces 66, 67, by way of which they butt against a lower edge 68 of the base 54 of the catch 51 when the trigger 61 is pulled, as a result of which the catch 51 is pivoted in a counterclockwise direction in FIG. 1 and the slide 4 is freed, in which case the latter, accelerated by the force of the spring 50, is moved forward in the direction of the barrel 1.

During this process, the crosspiece 42 pushes a cartridge out of the magazine 25 and introduces it into the chamber. As soon as the breechblock 9 is right in its forward position, the cartridge is ignited by the firing pin 44, whereupon the slide is moved back again by the cartridge under the action of the chamber pressure. The catch 51 is subjected to loading in the clockwise direction by a spring (not illustrated) and moves in this direction as soon as pressure on the trigger 61 is released. During the return movement of the slide, the cartridge strikes against the guide 38 and is thus ejected upward.

A safety bracket 69 is provided in order to prevent a shot from being fired unintentionally, said safety bracket likewise preferably comprising a punched sheet-metal part which has been bent in a U-shaped manner, and being mounted such that it can be pivoted about an axis 70. The legs 71, 72 of the safety bracket have hooks 73, 74, which act on the upper edge 75 of the base 54 of the catch 51 when the safety bracket 69 is located in its basic position, into which it is pushed in the clockwise direction by a spring (not illustrated).

The handle part 76 of the safety bracket 69 is located within the trigger 61, and in extension thereof, and is supported laterally, by way of protrusions 89, 90, on the side walls 46, 47 of the barrel holder 3. Since, when it is not subjected to pushing action, the safety bracket 69 blocks the catch 51, the catch 51 and thus also the slide are secured should the trigger be pulled unintentionally or the weapon be subjected to such pronounced impact that the catch 51 unlocks. If, however, the safety bracket 69 is subjected to pushing action at the same time, it can be assumed that the user is holding the weapon sufficiently firmly in his hand and is intending to shoot.

In the case of the barrel holder 3 (FIGS. 7*a* and 7*b*), the one wall 13 of the profile tube has been removed over approximately ⅔of the length and pairs of bores 77, 78 are provided in the two adjacent walls 46, 47, the bolts running along the axes 58 and 70 of the catch 51 and of the trigger 61, and/or of the safety bracket 69, being plugged through said bores. This makes it possible to form a trigger assembly 89 which is easy to install and remove.

Figure 16:
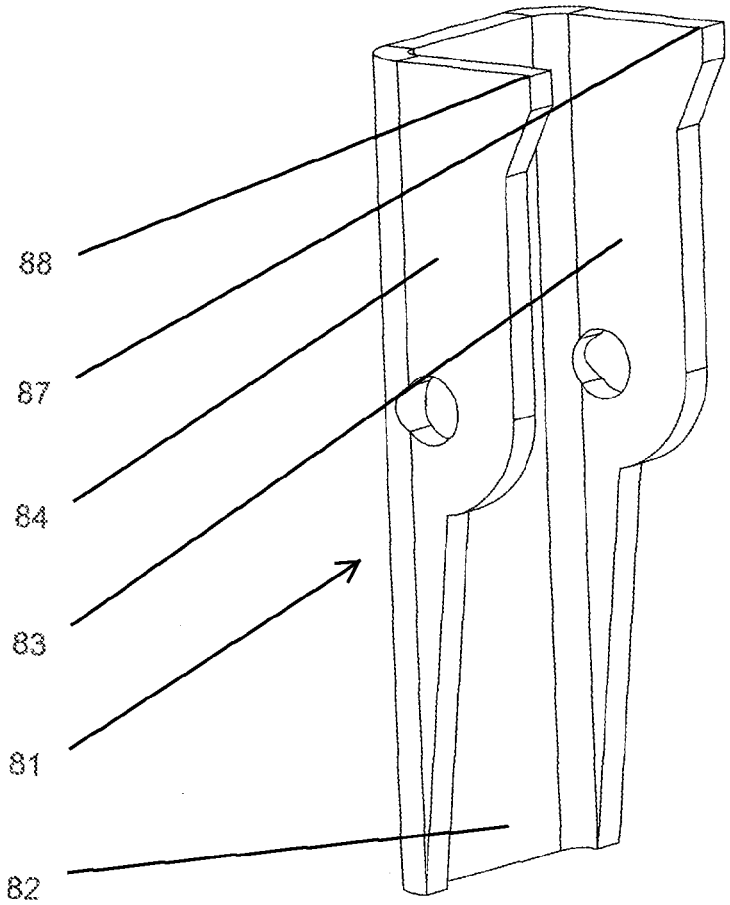
FIG. 16 shows a locking lever of the handgun.

The locking lever 81 according to FIG. 16 is likewise preferably produced from a punched sheet-metal part which has been bent in a U-shaped manner, and it has a base 82 and side walls 83, 84, of which the corners 87, 88 engage in an aperture in a wall of the magazine 25.

The invention claimed is:

1. An automatic handgun, comprising:

a barrel;

a blowback breech mechanism having a slide with a substantially U-shaped bracket and a breechblock disposed on said U-shaped bracket;

said U-shaped bracket being formed of an angled metal sheet, said bracket being a part having been punched out of a metal sheet and bent;

said U-shaped bracket having legs with free ends, said legs being aligned substantially parallel with an axis of said barrel;

said breechblock being accommodated between said legs at said free ends of said legs and said breechblock being affixed thereto; and said slide being mounted for displacement on a guide and on said barrel, and said slide being open on an upper side and a lower side.

2. The handgun according to claim 1, which comprises a compression spring disposed to enclose said barrel and clamped in between said bracket and said guide.

3. The handgun according to claim 1, wherein said guide is arranged on a trigger assembly.

4. The handgun according to claim 1, wherein said barrel projects through an opening formed in a base of said U-shaped bracket.

5. The handgun according to claim 1, wherein said guide is formed with two mutually opposite U-shaped depressions, and said legs of said U-shaped bracket are guided in said depressions.

6. The handgun according to claim 5, wherein said guide is arranged on a barrel holder, and said barrel is releasably fastened on said barrel holder.

7. The handgun according to claim 6, wherein said barrel holder is substantially cuboidal in a guide region and said U-shaped depressions are delimited by protrusions disposed thereon.

8. The handgun according to claim 7, wherein a pair of protrusions are disposed on a locking part, said locking part is fastened at an end of said barrel holder, and said locking part engages in a depression on said barrel.

9. The handgun according to claim 6, wherein said barrel holder comprises a rectangular profile tube with two openings in opposite walls, through which said barrel projects transversely to a longitudinal direction of said profile tube.

10. The handgun according to claim 9, which comprises a locking part plugged into an end of said profile tube and fastened there.

11. The handgun according to claim 1, further comprising a magazine well and a carrier plate disposed on said magazine well, and a second guide for said slide fastened at said carrier plate.

12. The handgun according to claim 11, wherein said carrier plate is formed with a pair of protrusions.

13. The handgun according to claim 11, which comprises a barrel holder fastened on said magazine well.

14. The handgun according to claim 11, which comprises a pivotably mounted catch arranged on said magazine well acting on a base of said U-shaped bracket.

15. The handgun according to claim 14, wherein said catch is a bracket that is bent substantially in a U-shape and has two legs, at the ends of which latching hooks are arranged, and wherein a trigger, which is mounted along a same axis as the catch, acts on a base that connects said two legs.

16. The handgun according to claim 15, wherein a pivotally mounted safety bracket acts on said base, on a side opposite said trigger, and wherein a handle part of said safety bracket runs in extension of said trigger.

17. The handgun according to claim 16, wherein said catch, said trigger and said safety bracket are mounted on said barrel holder.

18. The handgun according to claim 17, wherein said trigger forms a part of a trigger assembly fastened on said magazine well.

* * * * *